US005511474A

United States Patent [19]

Junghans

[11] Patent Number: 5,511,474

[45] Date of Patent: Apr. 30, 1996

[54] DRIVE FOR AN OSCILLATING ROLLER IN AN INKING UNIT OF A ROTARY PRINTING PRESS

[75] Inventor: Rudi Junghans, Wilhelmsfeld, Germany

[73] Assignee: Heidelberger Druckmaschinen AG, Heidelberg, Germany

[21] Appl. No.: 409,885

[22] Filed: Mar. 22, 1995

Related U.S. Application Data

[63] Continuation of Ser. No. 124,165, Sep. 20, 1993, abandoned.

[30] Foreign Application Priority Data

Sep. 18, 1992 [DE] Germany ..... 42 31 260.4

[51] Int. Cl.[6] ..... B41F 31/15

[52] U.S. Cl. ..... 101/348; 101/DIG. 38

[58] Field of Search ..... 101/348, 349, 101/350, 351, 352, 147, 148, DIG. 38, 216

[56] References Cited

U.S. PATENT DOCUMENTS

| | | |
|---|---|---|
| 2,155,354 | 4/1939 | Avery . |
| 2,520,688 | 8/1950 | Meyer et al. . |
| 3,118,373 | 1/1964 | Mosemille . |
| 4,198,908 | 4/1980 | Skiera . |
| 4,914,981 | 4/1990 | Hummel et al. . |
| 4,972,774 | 11/1990 | MacPhee . |

FOREIGN PATENT DOCUMENTS

| | | |
|---|---|---|
| 45547 | 4/1966 | Germany . |
| 2808856 | 9/1978 | Germany . |
| 289975 | 5/1991 | Germany . |

*Primary Examiner*—J. Reed Fisher
*Attorney, Agent, or Firm*—Herbert L. Lerner; Laurence A. Greenberg

[57] ABSTRACT

Drive for at least one oscillating roller in an inking unit of a rotary printing press, wherein the drive starts from a printing unit cylinder, and at least one oscillating roller is arranged in the inking unit for performing a lateral oscillating motion, includes a central gear-wheel for driving the oscillating roller, an intermediate gear-wheel in engagement with the central gear-wheel, and a bushing eccentrically arranged with respect to the oscillating roller, the intermediate gear-wheel being mounted on the bushing.

8 Claims, 2 Drawing Sheets

DRIVE FOR AN OSCILLATING ROLLER IN AN INKING UNIT OF A ROTARY PRINTING PRESS

Figure 1:
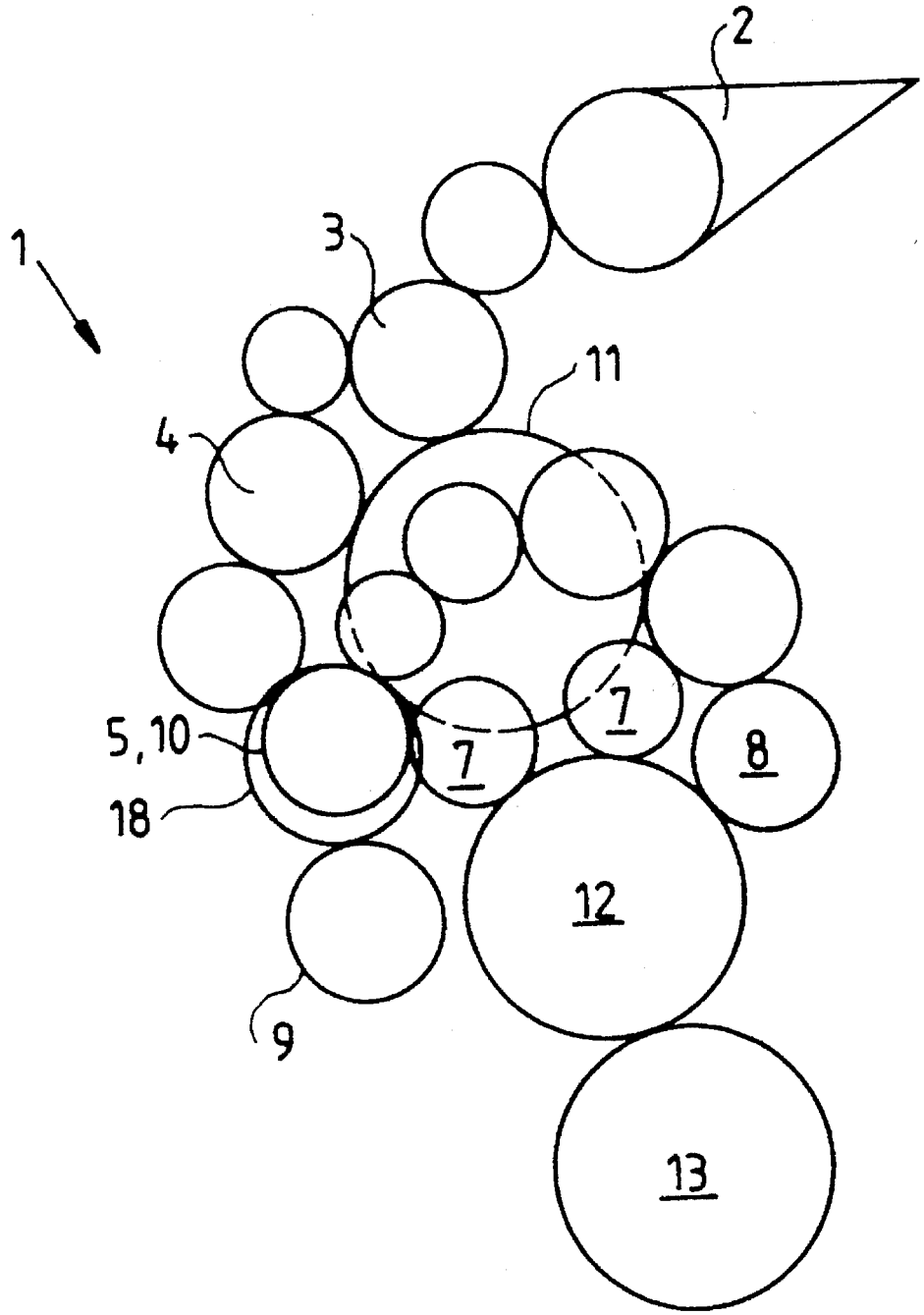

This application is a continuation of application Ser. No. 08/124,165, filed Sep. 20, 1993, now abandoned.

The invention relates to a drive for an oscillating or distributor roller in an inking unit of a rotary printing press, wherein the drive is introduced by a printing unit cylinder, and at least one oscillating roller is arranged in the inking unit for performing a lateral oscillating motion.

From the published German Patent Document 28 08 856 C2, an inking unit drive has become known which is introduced at two introduction positions. Furthermore, the upper part of an inking unit is driven by a vertically installed longitudinal shaft and a bevel gear transmission, and the drive in the lower part of the printing unit is introduced by a double bevel gear transmission. Disengagement or decoupling of the drive between an ink transfer roller in the upper part of the inking unit and a vibrator or oscillator roller in the lower part of the inking unit, therefore, necessitates the use of two bevel gear transmissions, an additional drive shaft, as well as a synchronization of both drive mechanisms with respect to one another.

U.S. Pat. No. 3,118,373 discloses a vibrator roller drive in a printing press. In this state of the art device, a central gear-wheel is driven by one of the gear-wheels oscillating the vibrator rollers, and the central gear-wheel, in turn, drives the individual vibrator rollers. Thus, the entire driving force required for the drive of the vibrator rollers is transmitted by this oscillating gear-wheel. Because this gear-wheel is used in a translatory as well as in a rotational function, it is subjected to various conditions of use, which may lead to a premature replacement of this gear-wheel.

It is accordingly an object of the invention to provide a drive of the foregoing general type which avoids the aforementioned disadvantages of heretofore known drives of this type.

It is another object of the invention to provide such a drive for oscillating or distributor rollers wherein optimal utilization and thereby a saving of installation space is effected, as well as a reduction in the requirement for mechanical components therefor.

With the foregoing and other objects in view, there is provided, in accordance with the invention, a drive for at least one oscillating roller in an inking unit of a rotary printing press, wherein the drive starts from a printing unit cylinder, and at least one oscillating roller is arranged in the inking unit for performing a lateral oscillating motion, comprising a central gear-wheel for driving the oscillating roller, an intermediate gear-wheel in engagement with the central gear-wheel, and a bushing eccentrically arranged with respect to the oscillating roller, the intermediate gear-wheel being mounted on the bushing.

An advantage of this construction according to the invention is that the driving force is switched over from the axially movable oscillating-roller gear-wheels to an intermediate gear-wheel fixed against axial movement, the mechanical load of the oscillating-roller gear-wheel components being greatly reduced. Due to the eccentric mounting of the intermediate gear-wheel, the distance to be bridged in the driving gear train is such that the axial oscillating motion of the oscillating roller is in no way limited, yet the wear and tear on the oscillating-roller gear-wheel is greatly reduced.

In accordance with another feature of the invention, the oscillating roller has a journal, and an intermediate gear-wheel bushing through which the journal extends is included. This permits the placement of a force-transmitting gear-wheel, while optimally utilizing installation space and not limiting the lateral oscillating motion of the oscillating roller.

In accordance with a further feature of the invention, the drive includes an oscillating-roller gear-wheel secured to the oscillating roller, and the intermediate gear-wheel is mounted so as to be fixed against movement in axial direction and has a diameter exceeding the diameter of the oscillating-roller gear-wheel.

In accordance with an added feature of the invention, the drive includes an axially movable coupling wheel engageable with the intermediate gear-wheel bushing. A result thereof is that there will be a single decouplable force-introduction position for the oscillating-roller drive. In accordance with an additional feature of the invention, the oscillating roller has a journal, and an axial drive floatingly acting upon the journal is included, the oscillating-roller gear-wheel being mounted on the journal of the oscillating roller and entering into an opening formed in the intermediate gear-wheel bushing during the oscillating motion of the oscillating roller effected by the axial drive.

In accordance with yet another feature of the invention, the oscillating roller has a journal, and an oscillating-roller bearing supporting the intermediate gear-wheel bushing is included so that the intermediate gear-wheel bushing has an eccentricity with respect to the oscillating-roller journal, the intermediate gear-wheel being mounted on the intermediate gear-wheel bushing through the intermediary of roller bearings.

In accordance with a concomitant feature of the invention, the drive includes an axially movable coupling wheel engageable with the intermediate gear-wheel, and means for transmitting the drive from a printing-unit cylinder via the axially movable coupling wheel to the eccentrically mounted intermediate gear-wheel and from the intermediate gear-wheel to the central gear-wheel for simultaneously driving the oscillating-roller gear-wheel of the oscillating roller.

Other features which are considered as characteristic for the invention are set forth in the appended claims.

Although the invention is illustrated and described herein as embodied in a drive for oscillating rollers in an inking unit of a rotary printing press, it is nevertheless not intended to be limited to the details shown, since various modifications and structural changes may be made therein without departing from the spirit of the invention and within the scope and range of equivalents of the claims.

Figure 2:
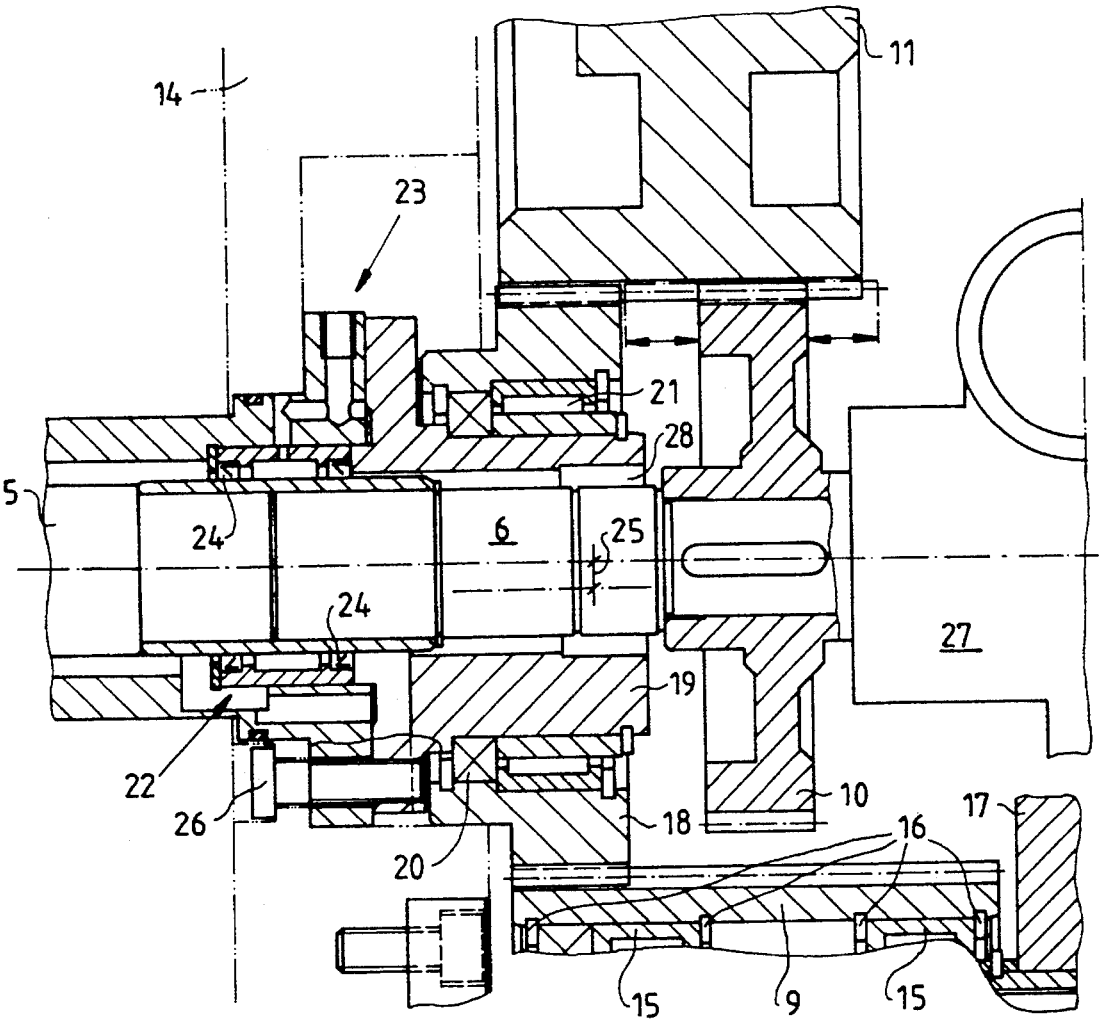

The construction and method of operation of the invention, however, together with additional objects and advantages thereof will be best understood from the following description of specific embodiments when read in connection with the accompanying drawings, in which:

FIG. 1 is a diagrammatic side elevational view of a printing and inking unit; and FIG. 2 is a longitudinal sectional view of an oscillating or distributor roller bearing above a couplable or engageable gear-wheel.

Referring now to the drawings and, first, particularly to the cross-sectional illustration of the printing and inking unit of FIG. 1, it is believed to be clear therefrom that the ink flow in the inking unit 1 starts from an ink duct 2, and continues over oscillating or distributor rollers 3, 4 and 5 positioned between various inking rollers, and onto ink form or applicator rollers 7 and 8. In the inking unit 1 shown in Fig, 1, for example, two ink form rollers 7 and a further ink form roller 8 are assigned to a printing form cylinder 12. The printing form cylinder 12 inked by the ink form rollers 7 and 8, in turn, inks a rubber blanket cylinder 13 which, together with a non-illustrated rubber blanket cylinder of a printing unit located therebelow, prints a passing material web on both sides thereof. To the oscillating roller 5 there is fastened a oscillating-roller gear-wheel 10 which meshes with a central gear-wheel 11. The oscillating rollers 3 and 4 also have a respective oscillating roller gear-wheel 10 which have not been illustrated in the interest of clarity. Accordingly, the oscillating roller gear-wheels 10 of all of the oscillating rollers 3, 4 and 5 are driven via the central gear-wheel 11. Adjacent the oscillating roller gear-wheel 10, the central gear-wheel 11 is in engagement with an intermediate gear-wheel 18 which is arranged eccentrically with respect to the oscillating roller 5 and its oscillating-roller gear-wheel 10. Below the intermediate gear-wheel 18, is an axially movable coupling wheel 9 with which a non-illustrated oscillating dampening roller can be driven.

FIG. 2 is a longitudinal sectional view of an oscillating roller bearing above a couplable or engageable wheel. In a side wall 14 of the inking unit 1, the coupling wheel 9, rotatably mounted in ball bearings, is arranged so as to be axially movable by means of a lever 17. The position of the ball bearings 15 is secured by retaining rings 16.

Above the coupling wheel 9, an intermediate gear-wheel 18 is mounted on an intermediate gear-wheel bushing 19. The intermediate gear-wheel 18 is constructed as a toothed ring gear and is received via bearings 20 and 21 on the intermediate gear-wheel bushing 19. The intermediate gear-wheel 18 is held in a defined axial position. The intermediate-gear-wheel bushing 19 is screwed to an oscillating roller bearing 22 by means of several holding screws 26 and, in this manner, taken up in the side wall 14. The intermediate gear-wheel bushing 19 is arranged so as to be offset by an eccentricity 25 with respect to an oscillating roller journal 6 which is mounted within the oscillating roller bearing 22 so as to be axially movable. Within the oscillating roller bearing 22, two sealing rings 24 are arranged so as to seal off the hollow space in the oscillating roller bearing 22, a pressurized-oil feed pipe 23 being connected to the hollow space. The oscillating roller journal 6 is part of the body of the oscillating roller 5, which is not otherwise illustrated herein. On the oscillating roller journal 6, the oscillating-roller gear-wheel 10 is mounted and serves to drive the oscillating roller body. The introduction of the axial oscillating motion takes place via an axial drive 27 which has an overhung mounting. The range of the oscillating motion is represented by the double-headed arrows shown in the upper region of the oscillating-roller gear-wheel 10, as viewed in FIG. 2.

The intermediate gear-wheel 18, as well as the oscillating-roller gear-wheel 10, mesh with the central gear-wheel 11. In this regard, the central gear-wheel 11 remains in constant engagement with the intermediate gear-wheel 18. Thus, the intermediate gear-wheel 18 which meshes with the coupling wheel 9, in a coupled state thereof, introduces the force for the oscillating roller drive. Consequently, the axially moving oscillating roller gear-wheel 10 of the oscillating roller 5 is being relieved. The lateral oscillating motion of the oscillating roller 5 generated by the axial drive 27 can thus be fully utilized, because the hub of the oscillating roller gear-wheel 10 can enter into an enlarged opening 28 formed in the intermediate gear-wheel bushing 19 as the latter moves towards the side wall 14, so that the full width of the central gear-wheel 11 is used.

The central gear-wheel 11 is mounted via ball bearings on a pin fastened to the side wall 14. The tooth width or pitch of the central gear-wheel 11, on the one hand, enables a stable introduction of force through the eccentrically mounted intermediate gear-wheel 18 and, on the other hand, permits the driving of the axially movable oscillating roller gear-wheels 10. By using the eccentrically mounted intermediate gear-wheel bushing 19, the drive of the central gear-wheel 11 can take place via the intermediate gear-wheel 18 which is of increased diameter compared to the diameter of the gear-wheel 10, the lateral oscillating motion of the oscillating roller 5 being unlimited, yet the installation space at the side wall 14 being optimally utilized.

I claim:

1. A drive assembly, comprising:

a central drive gear and an oscillating roller driven by said central drive gear; said oscillating roller having a roller axis and an oscillating roller gear meshing with said central drive gear;

an axial drive connected to said oscillating roller and disposed coaxially with said oscillating roller for introducing an axially oscillating motion to said oscillating roller;

an intermediate gear wheel meshing with said central gear wheel, and a bushing rotatably supporting said intermediate gear wheel;

an active drive gear meshing with said intermediate gear wheel and rotatingly driving said oscillating roller; and said bushing being mounted eccentrically relative to said oscillating roller such that said oscillating roller is rotatingly driven by said active drive gear via said intermediate gear wheel, said central drive gear and said oscillating roller gear independently of the axially oscillating motion of said oscillating roller.

2. The assembly according to claim 1, wherein said oscillating roller is a plurality of oscillating rollers disposed about said central drive gear, and each of said oscillating rollers having a respective oscillating roller gear meshing with said central drive gear.

3. The assembly according to claim 1, wherein said oscillating roller has a journal connected to said axial drive and extending through said bushing.

4. The assembly according to claim 3, further comprising an oscillating roller bearing rotatably supporting said oscillating roller, said bushing being supported at said oscillating roller bearing with a given eccentricity relative to said oscillating roller.

5. The assembly according to claim 1, wherein said intermediate gear wheel is mounted so as to be fixed against movement in the axial direction and has a diameter exceeding a diameter of said oscillating roller gear.

6. The assembly according to claim 1, wherein said active drive gear is an axially shiftable coupling wheel.

7. The assembly according to claim 1, which further comprises an impression cylinder rotatingly driving said oscillating roller via said oscillating roller gear.

8. A drive assembly in a printing unit with an impression cylinder, comprising:

a central drive gear and a plurality of oscillating rollers driven by said central drive gear; each of said oscillating rollers having a roller axis and an oscillating roller gear meshing with said central drive gear; said central drive gear being rotationally coupled to an impression cylinder of the printing unit such that the impression cylinder imparts a rotation on said oscillating rollers;

a plurality of axial drives each coaxially mounted on a respective one of said oscillating rollers, said axial drives imparting an axially oscillating motion to each of said oscillating roller;

a plurality of bushings each eccentrically disposed relative to a respective one of said oscillating rollers, and an intermediate gear wheel rotatably supported on each of said bushings and meshing with said central gear wheel; and an active drive gear meshing with said intermediate gear wheel and rotatingly driving said oscillating rollers through a drive train defined from said active drive gear, through said intermediate gear wheel, through said central drive gear, and to said oscillating roller gear.

* * * * *